US006170185B1

(12) United States Patent
Donofrio, Jr.

(10) Patent No.: US 6,170,185 B1
(45) Date of Patent: Jan. 9, 2001

(54) HANGING DISPLAY DEVICE FOR MEMORABILIA

(76) Inventor: Nicholas Donofrio, Jr., 3 Wildflower Dr., Oxford, CT (US) 06478

( * ) Notice: Under 35 U.S.C. 154(b), the term of this patent shall be extended for 0 days.

(21) Appl. No.: 09/264,378

(22) Filed: Mar. 5, 1999

(51) Int. Cl.[7] ..... A47G 25/10; A47G 1/06
(52) U.S. Cl. ..... 40/800; 211/32; 211/30
(58) Field of Search ..... 40/800; 248/216.1, 248/216.4, 217.1; 211/32, 30

(56) References Cited

U.S. PATENT DOCUMENTS

| | | | | |
|---|---|---|---|---|
| 2,572,454 | | 10/1951 | Down, et al. . | |
| 2,727,325 | | 12/1955 | Jurinic . | |
| 3,231,993 | | 2/1966 | Levy . | |
| 3,319,922 | * | 5/1967 | Christensen | 40/800 |
| 3,559,935 | | 2/1971 | Gardner . | |
| 3,837,545 | * | 9/1974 | Rogers, Jr. | 211/30 X |
| 4,193,495 | * | 3/1980 | Keeley | 294/143 |
| 4,684,096 | * | 8/1987 | Tanaka | 211/32 X |
| 4,746,118 | * | 5/1988 | Deveney | 473/458 |
| 4,885,806 | * | 12/1989 | Heller | 2/423 |
| 5,082,110 | | 1/1992 | Hager . | |
| 5,240,123 | * | 8/1993 | Hawk | 211/32 |
| 5,377,829 | | 1/1995 | Bahl . | |
| 5,480,073 | * | 1/1996 | LaManna | 211/32 X |
| 5,758,779 | * | 6/1998 | Atkins | 211/30 X |
| 5,762,206 | * | 6/1998 | Leichter | 211/30 X |
| 5,921,403 | * | 7/1999 | Coffaro | 211/30 X |
| 5,967,344 | * | 10/1999 | Liberati | 211/32 X |

* cited by examiner

*Primary Examiner*—Terry Lee Melius
*Assistant Examiner*—James M Hewitt
(74) *Attorney, Agent, or Firm*—Cummings & Lockwood

(57) ABSTRACT

A display device including a plaque, a hanger secured to a rear face of the plaque for hanging the plaque on a vertical surface such that the rear face of the plaque is substantially parallel with the vertical surface, a support assembly secured to a front face of the plaque, and memorabilia held by the support assembly, wherein the support is adapted to hold the memorabilia in an upright position with respect to the vertical surface.

6 Claims, 5 Drawing Sheets

Fig. 9
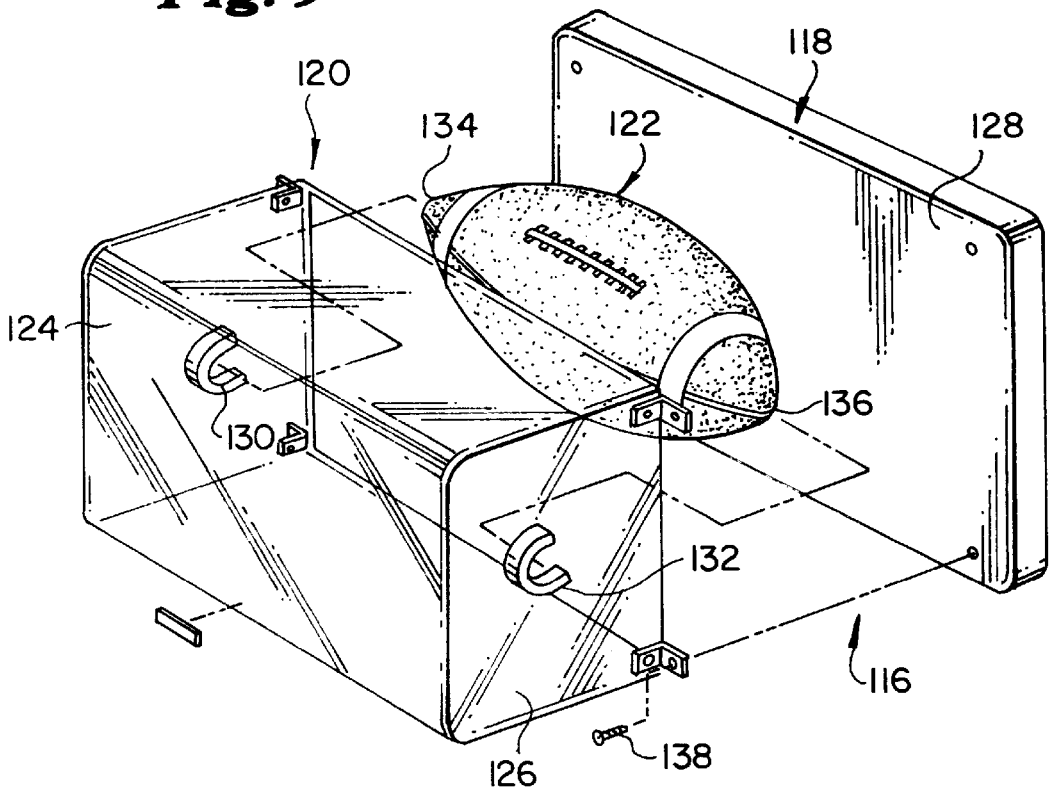
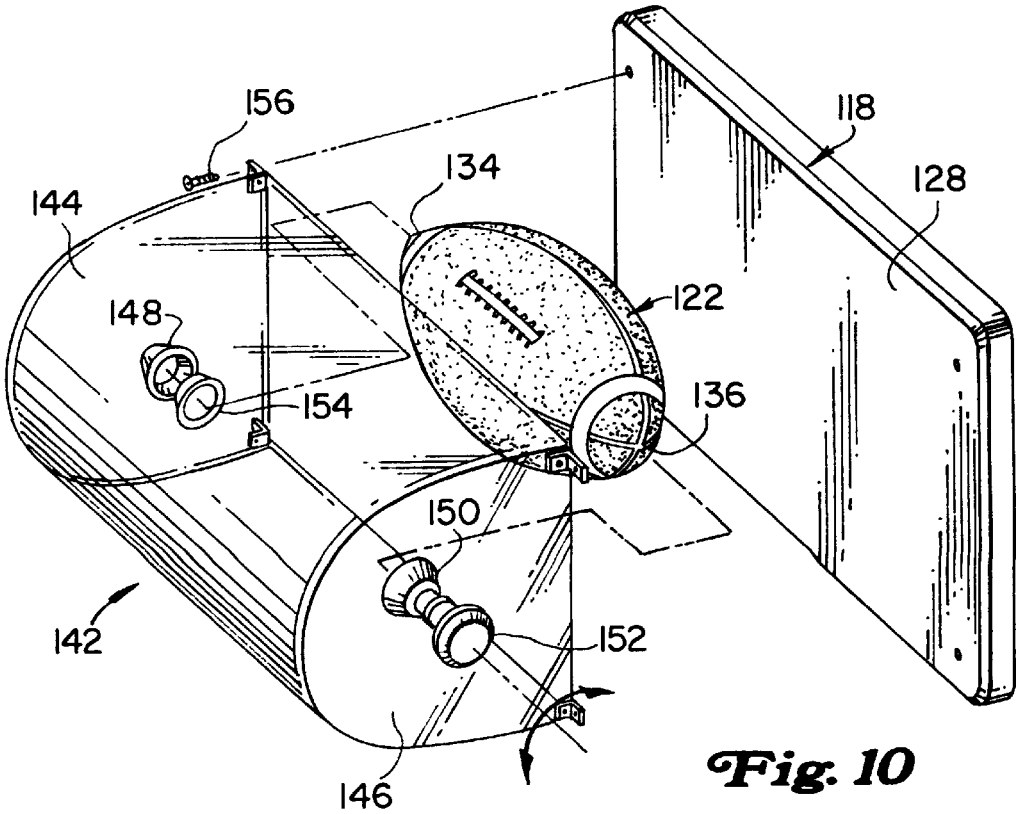
Fig. 10

HANGING DISPLAY DEVICE FOR MEMORABILIA

FIELD OF DISCLOSURE

The present disclosure relates to a display device, and, more particularly, relates to a hanging display device for displaying memorabilia and, in particular, sports memorabilia, such as, for example, a ball or a helmet.

Often it is desirable to display a ball or a helmet, or other sport memorabilia as a trophy, such as when the memorabilia has been signed by a famous professional athlete, or when the memorabilia has been awarded to a player for his or her performance in a game, or when the memorabilia bears a team's indicia and is displayed to show loyalty to that team.

Preferably a display device for sports memorabilia will present and display the memorabilia, whether it be a football, baseball, basketball or helmet, for example, in an attractive fashion. It is also preferably that a display device for sports memorabilia be adapted for hanging on a vertical surface, such as a wall, and be simple and economical in design. Furthermore, it is preferably that a display device for sports memorabilia support the sport memorabilia in an upright and correct position with respect to the vertical surface.

SUMMARY OF DISCLOSURE

Accordingly, the present disclosure provides a display device including a plaque, a hanger secured to a rear face of the plaque for hanging the plaque on a vertical surface such that the rear face of the plaque is substantially parallel with the vertical surface, a support assembly secured to a front face of the plaque, and memorabilia held by the support assembly. Wherein the support is adapted to hold the memorabilia in an upright position with respect to the vertical surface.

According to one aspect of the present disclosure, the memorabilia comprises a helmet and the support assembly comprises a spacer positioned between the helmet and the plaque, and a fastener passing through a hole in the helmet, through the spacer and secured to the plaque. The spacer has a flat surface abutting the front face of the plaque and an opposing contoured surface abutting the helmet and contoured to match an outer contour of the helmet such that the helmet is in an upright position with respect to the vertical surface.

According to another aspect of the present disclosure, the memorabilia comprises a helmet and the support assembly comprises a first clamp arm positioned between the helmet and the plaque and a second clamp arm positioned within the helmet. The first clamp arm has contoured portion abutting the helmet. The contoured portion of the first clamp arm is contoured to match an outer contour of the helmet such that the helmet is in an upright position with respect to the vertical surface. The second clamp arm has a gripping portion directed towards the curved portion of the first clamp arm and securing the helmet against the curved portion of the first clamp arm. The support assembly also includes a fastener securing the clamp arms to the plaque.

According to an additional aspect of the present disclosure, the memorabilia comprises a helmet and the support assembly comprises a resilient curved prong clamping a sidewall of the helmet and removably securing the helmet in an upright position.

According to a further aspect of the present disclosure, the memorabilia comprises a helmet and the support assembly comprises a backing plate secured to the plaque, a first panel extending from the backing plate, and a second panel intersecting the first panel. The helmet is removably supported in an upright position on the first and the second panels.

According to still another aspect of the present disclosure, the support assembly comprises a transparent case secured to the plaque. The case has opposing endwalls extending from the plaque, and a cup secured to each endwall, with the memorabilia held between the cups.

Still other features and advantages will become apparent upon reading the following detailed description in conjunction with the drawings and the appended claims.

BRIEF DESCRIPTION OF DRAWINGS

FIG. 9 is a front isometric exploded view of another display device according to the present disclosure shown holding and displaying a ball; and FIG. 10 is a front isometric exploded view of an additional display device according to the present disclosure shown holding and displaying a ball.

DETAILED DESCRIPTION OF DISCLOSURE

Figure 1:
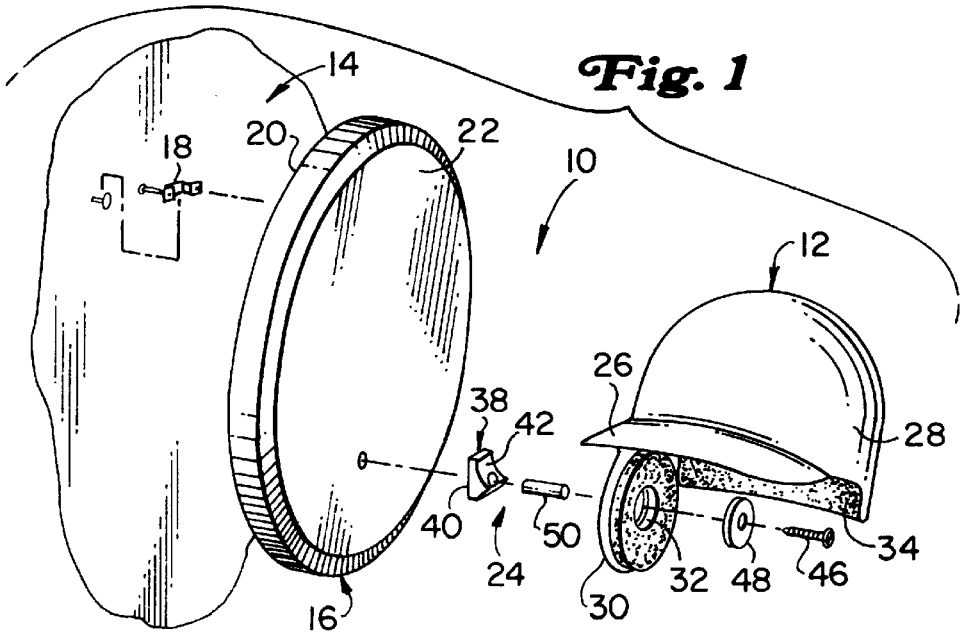
FIG. 1 is a front isometric exploded view of a display device according to the present disclosure shown hung from a vertical surface and holding a helmet.
Figure 2:
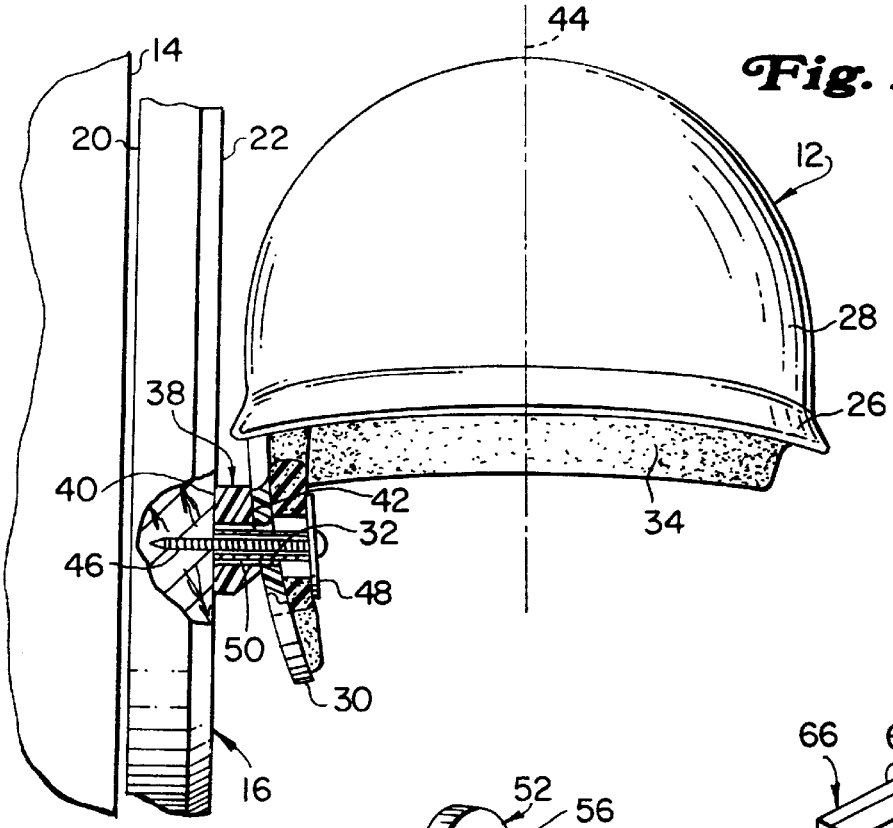
FIG. 2 is a front elevation view, partially cut away, of the display device of FIG. 1.
Figure 2A:
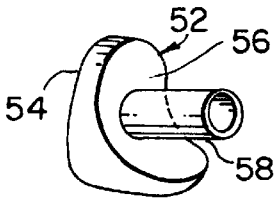
FIGS. 2*a* and 2*b* show alternative spacers for the display device of FIGS. 1 and 2.
Figure 2B:
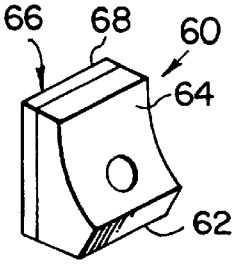

Referring first to FIGS. 1 and 2, a hanging display device 10 for displaying memorabilia and, in particular, sports memorabilia 12 is provided. It may be desirable to display sports memorabilia for a number of reasons. For example, the memorabilia could be autographed by a famous athlete or athletes, or earned by an individual as a most valuable player, i.e., a "game ball", or a championship ball earned by a team. It may also be desirable and advantageous that a display device for memorabilia be adapted to be hung from a vertical surface, such as a wall 14, as opposed to being placed on a horizontal surface, such as a table. Thus, the present disclosure provides a display device 10 for displaying sports memorabilia 12 that can be hung from a vertical surface 14.

The hanging display device 10 includes a plaque 16 with a hanger 18 secured to a rear face 20 of the plaque for hanging the plaque on the vertical surface 14 such that the rear face of the plaque is substantially parallel with the vertical surface. In addition, a front face 22 of the plaque 16 is parallel with the rear face 20, but not necessarily so. The plaque 16 can be made from any suitable rigid and strong material, such as wood, plastic, metal or stone.

The display device 10 also includes a support assembly 24 secured to the front face 22 of the plaque 16, and memorabilia 12 held by the support assembly. As shown, the support assembly 24 is adapted to hold the memorabilia 12 in an upright position with respect to the vertical surface 14. As shown, the memorabilia is provided in the form of a batting helmet 14 for baseball, including a visor 26, a curved sidewall 28, and an ear shield 30 extending from the sidewall and having an ear hole 32. The batting helmet also includes padding 34 within its interior.

By "being held upright with respect with respect to the vertical surface" it is meant that the helmet or the memorabilia 12 is held such that it does not appear to be tilted or lopsided with respect to the wall 14. This is more particularly defined by stating that an imaginary, centrally located vertical plane 44 of the helmet 12 is parallel with the wall 14.

The support assembly 24 includes a spacer 38 positioned between the helmet 12 and the plaque 16. The spacer 38 has a flat surface 68 abutting the front face 22 of the plaque and an opposing, contoured surface 42 abutting the curved sidewall 28 of the helmet 12. The contoured surface 42 of the spacer 38 is contoured to match, or complement, an outer contour of the helmet 12 such that the helmet is held in an upright position, with respect to the wall 14, when attached to the plaque 16 with the spacer there between. The spacer 38 may be made from a suitably rigid material that won't deform under the weight of the helmet 12, such as rubber, plastic or metal, for example. It should be noted that the spacer and the plaque can be unitarily formed as a single piece.

The helmet 12 is held to the plaque 16 by a fastener 46 that passes through the ear hole 32 and the spacer 38 and is secured to the plaque. As shown, the fastener comprises a threaded screw 46 that is threadedly received in the plaque 16, which in the particular embodiment of FIGS. 1 and 2 is made of wood. A washer 48 is positioned between a head of the screw 46 and the ear shield 30. A sleeve 58 is also provided to protect the helmet 12 from the screw 46. The fastener could also be provided in the form of a nut and a bolt, for example.

Another spacer 52 for use with the hanging display 10 device of FIGS. 1 and 2 is shown in FIG. *2a*. The spacer 52 includes a flat surface 54 for abutting the plaque 16, an opposing contoured surface 56 for abutting the sidewall 28 of the helmet, and a unitary sleeve 58 extending from the contoured surface for extending through the ear hole 32, to protect the ear shield 30 from the fastener 46.

Referring to FIG. *2b*, a spacer 60 that can be custom formed may alternatively be provided and preferably includes a malleable portion 62 for forming a contoured surface 64, and a rigid non-malleable flat plate 66 forming a flat surface 68 abutting the plaque 16. By malleable it is meant that the contoured surface 64 of the spacer 60 can be formed to match the contour of a particular helmet 12, whereby a kit, including just the plaque 16, with the hanger 18, the spacer 60 and the fastener 46, could be provided for use with any size or type of helmet, such as a batting helmet, a football helmet, a hockey helmet or a lacrosse helmet, for example. The malleable portion 62 of the spacer 60 is made of a soft, yet rigid material, such as balsa wood, rubber or plastic foam, that can be trimmed or formed by a sharp instrument, such as a knife. The malleable portion 62 could alternatively be made of a material that can be formed into a preferred contour and then allowed to harden, such as clay or putty, or a material that can be heated until pliable, formed into a preferred contour, then allowed to cool and harden, such as wax.

Figure 3:
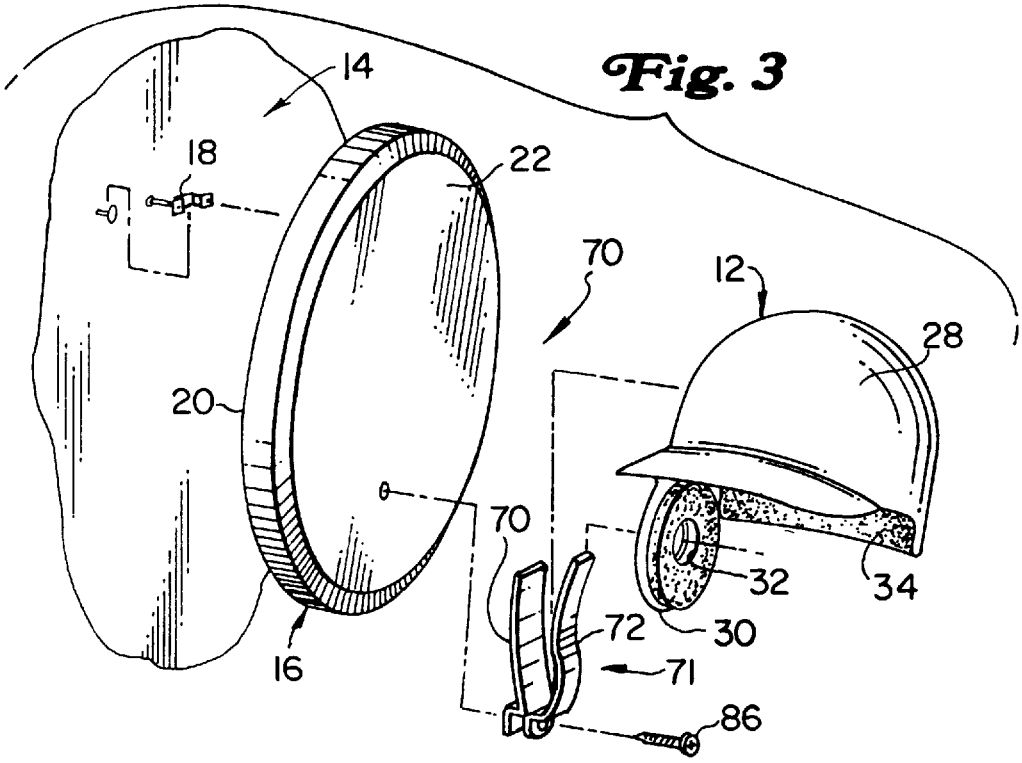
FIG. 3 is a front isometric exploded view of another display device according to the present disclosure shown hung from a vertical surface and holding a helmet.
Figure 4:
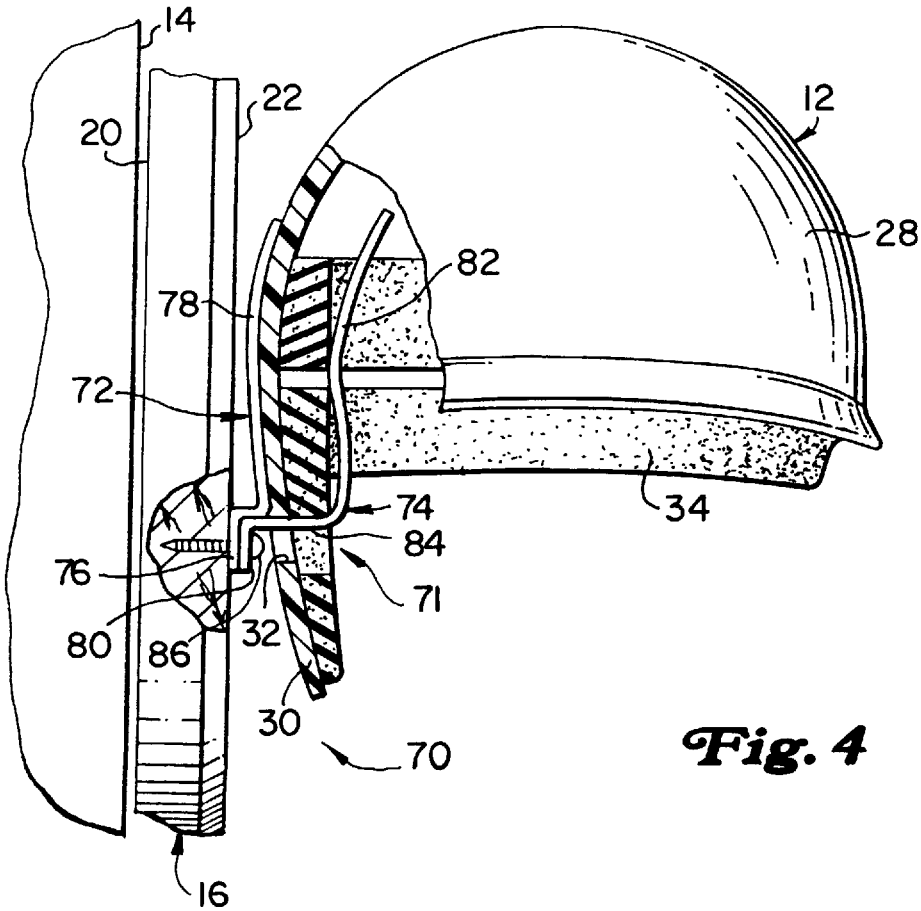
FIG. 4 is a front elevation view, partially cut away, of the display device of FIG. 3.

Referring now to FIGS. 3 and 4, another hanging display device 70 including a support assembly 72 is shown. The support assembly 72 includes first and second clamp arms 74, 76 cooperating to hold the helmet 12 secured in an upright position with respect to the wall 14. The first clamp arm 74 is positioned between the helmet 12 and the plaque 16, and has a flat portion 76 abutting the front face 22 of the plaque and a contoured portion 78 extending from the flat portion and abutting the helmet. The contoured portion 78 is curved to match an outer curve of the sidewall 28 of the helmet 12 such that the helmet is in an upright position with respect to the wall 14. The second clamp arm 74 is positioned within the helmet 12 and has a flat portion 80 abutting the flat portion 76 of the first clamp arm 72, and a gripping portion 82 extending from its flat portion, directed toward the contoured portion 78 of the first clamp arm, and securing the sidewall 28 of the helmet 12 against the contoured portion. The second clamp arm 74 also includes an intermediate portion 84 between its flat and gripping portions 78, 80 that extends through the ear hole 32 of the helmet 12. A fastener in the form of a screw 86 passes through holes in both flat portions 76, 80 of the clamp arms and is secured in the plaque 16.

Figure 5:
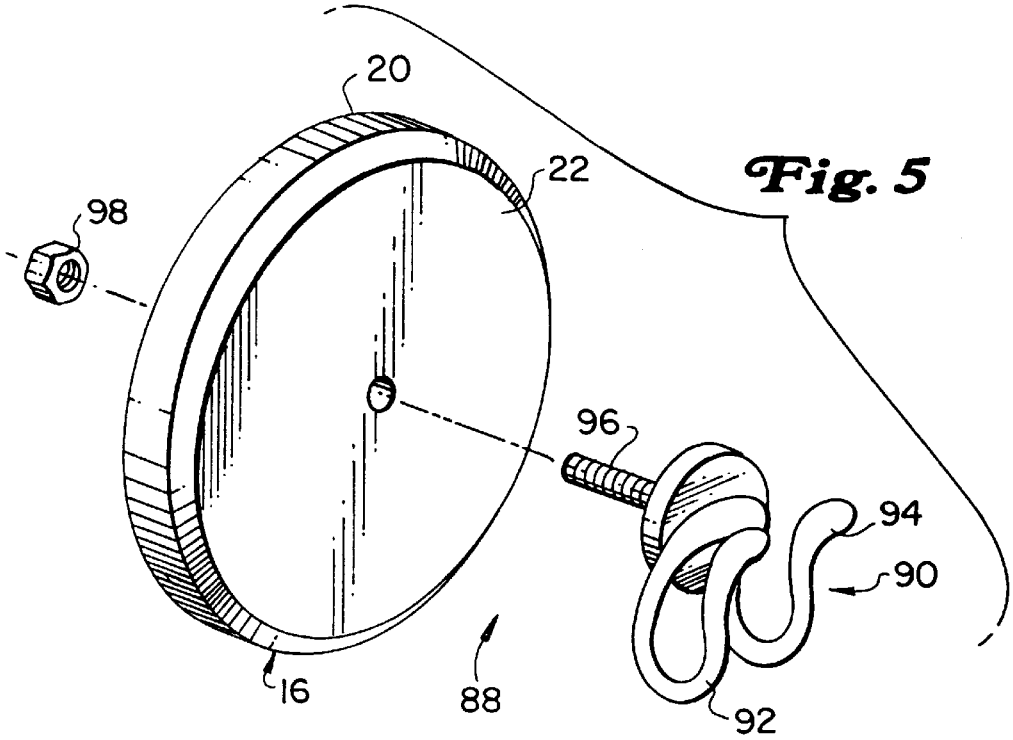
FIG. 5 is a front isometric exploded view of an additional display device according to the present disclosure shown hung from a vertical surface and holding a helmet.
Figure 6:
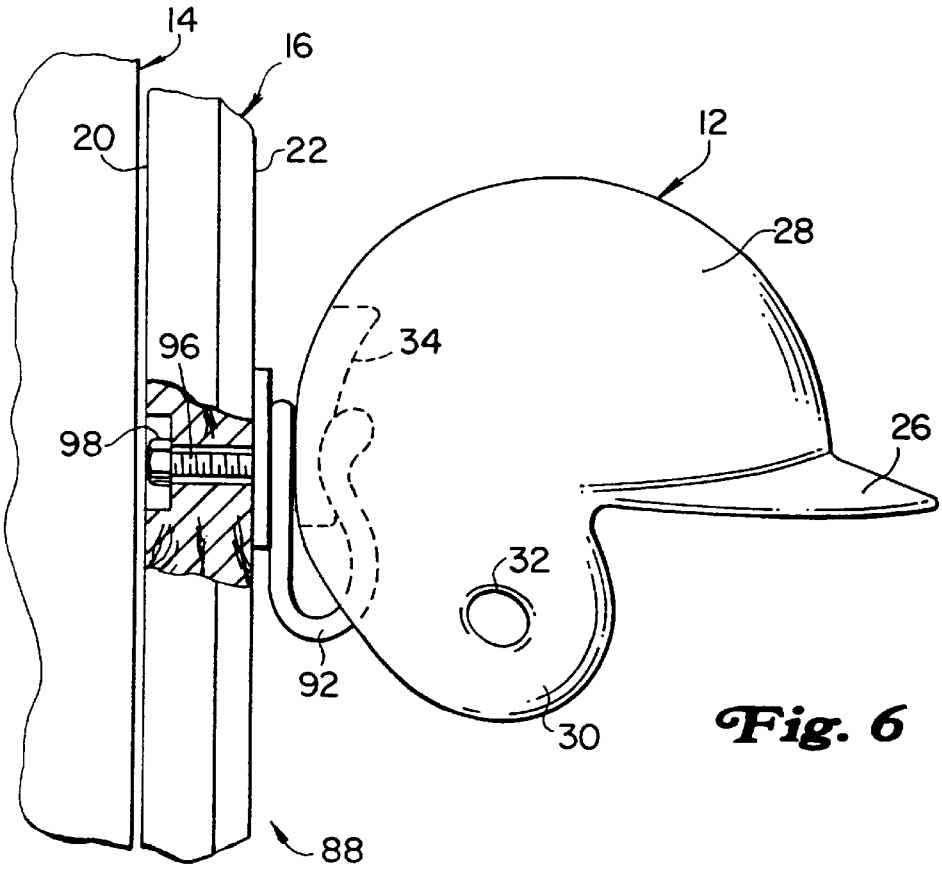
FIG. 6 is a front elevation view, partially cut away, of the display device of FIG. 5.

Referring to FIGS. 5 and 6, an additional hanging display device 88 is shown and includes a support assembly 90 having two resilient, curved prongs 92, 94 clamping the sidewall 28 of the helmet 12 and securing the helmet in an upright position. The curved prongs 92, 94 are unitarily formed with each other and with a threaded stud 96 that extends through the plaque 16 and secured with a nut 98. The resilient curved prongs 92, 94, which are made from plastic or metal for example, provide the benefit of securably mounting the helmet 12 to the plaque 16 in an upright position, yet allow the helmet to be removed and handled without having to disassembly the support assembly from the plaque.

Figure 7:
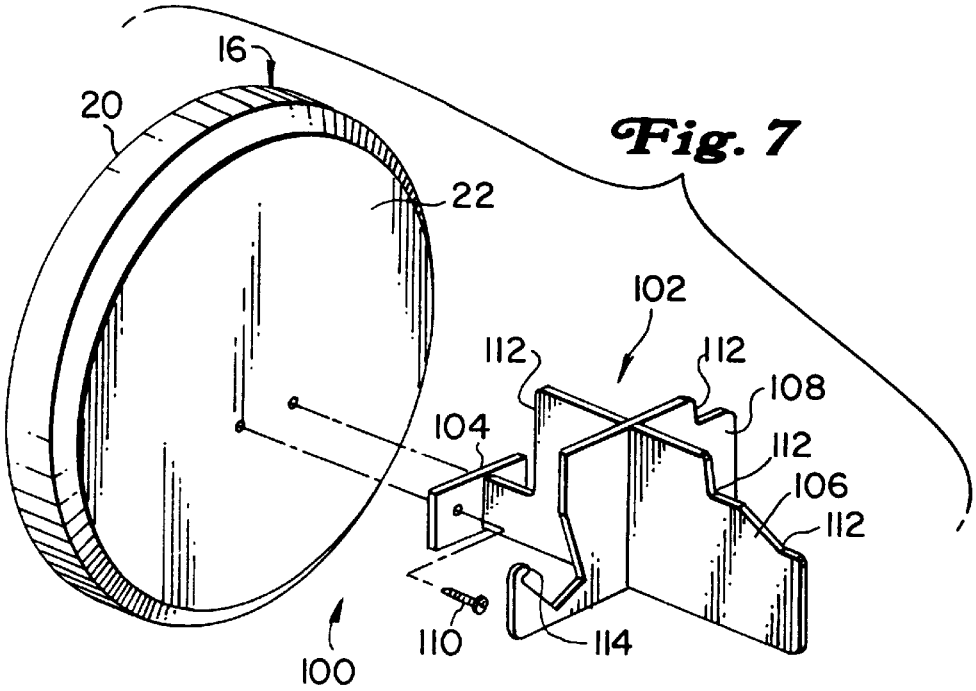
FIG. 7 is a front isometric exploded view of a further display device according to the present disclosure shown hung from a vertical surface and holding a helmet.
Figure 8:
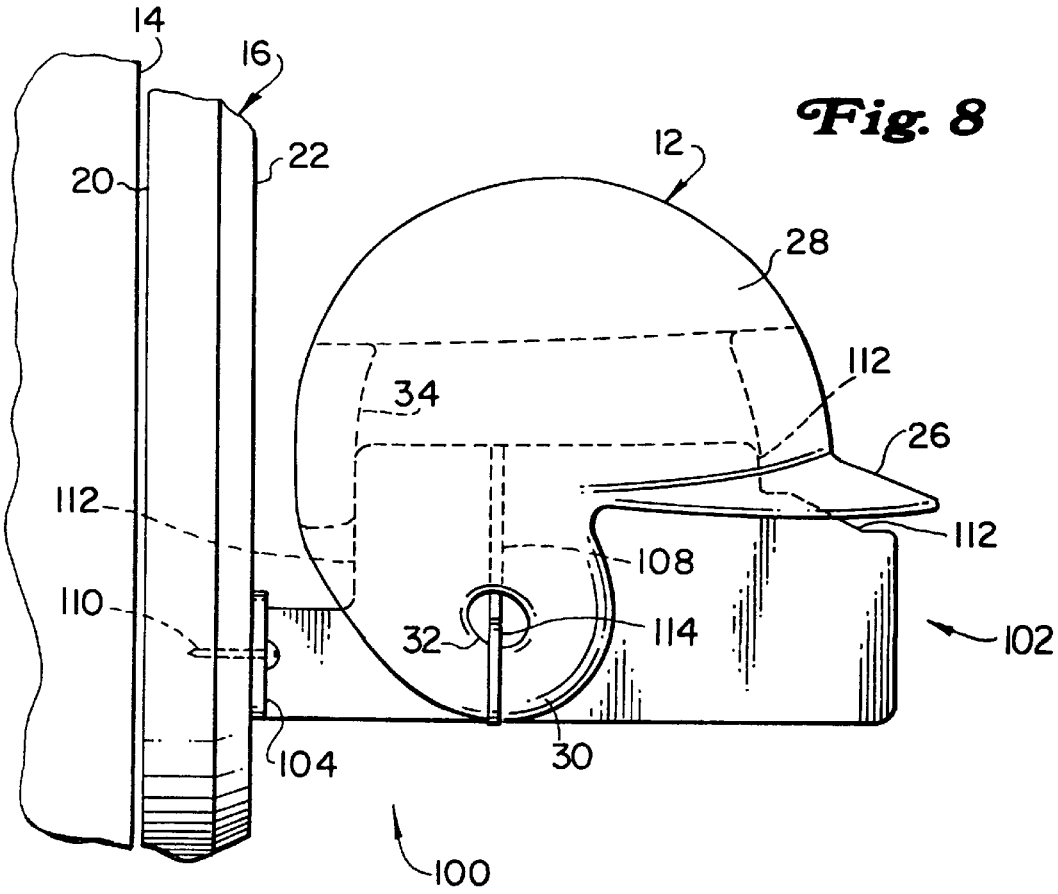
FIG. 8 is a front elevation view, partially cut away, of the display device of FIG. 7.

Referring to FIGS. 7 and 8, a further hanging display device 100 is shown and includes a support assembly 102 having a backing plate 104 secured to the plaque 16, a first panel 106 extending from the backing plate, and a second panel 108 intersecting the first panel. The panels 106, 108 and the backing plate 104 are made of any suitably rigid and strong material, such as plastic, glass or metal, and are unitarily formed, or secured to each other with glue or welds, for example. The backing plate 104 of the support assembly 102 is secured to the plaque 16 with fasteners in the form of screws 110, and the helmet 12 is supported in an upright position on the first and the second panels 106, 108. As shown, the panels 106, 108 are provided with steps 112, such that upper portions of the panels extend into the interior of the helmet 12. In addition, the second panel includes a hook 114 engaging the ear hole 32 of the helmet 12 to secure the helmet in an upright position on the first and the second panels 106, 108. Whereby, the helmet 12 is securably mounted to the plaque 16 in an upright position, yet can be removed and handled without having to disassembly the support assembly 102 from the plaque 16.

FIG. 9 shows another hanging display device 116 including a plaque 118 and a support assembly in the form of a transparent case 120 secured to the plaque. The transparent case 120 encloses and retains a piece of memorabilia, which, in the embodiment shown, comprises a football 122, in an upright position with respect to the vertical surface 14 upon which the plaque is mounted. The case 120 has opposing endwalls 124, 126 extending from a front face 128 of the plaque, and a U-shaped cup 130, 132 secured to each endwall for receiving the tips 134, 136 of the football 122 to secure the football there between. The transparent case 120, which is made of glass or plastic, is secured to the plaque 118 with fasteners, such as screws 138.

FIG. 10 shows an additional hanging display device 140 including a support assembly in the form of a transparent case 142 secured to the plaque 118. The transparent case 142 encloses and retains a piece of memorabilia, which, in the embodiment shown, comprises a football 122, in an upright position with respect to the vertical surface 14 upon which the plaque 118 is mounted. The case 142 has opposing endwalls 144, 146 extending from the front face 128 of the plaque 118, and concave cups 148, 150 secured to each endwall for receiving the tips 134, 136 of the football 122 to secure the football there between. In addition, one of the cups 150 is rotatably mounted in the endwall 146 and includes a knob 152 extending through the endwall for allowing the cup and, thus, the football 122 to be rotated within the case 142. The other of the cups 148 may be provided with a nonfriction liner 154 for allowing the ball 122 to be more easily rotated. The transparent case 142, which is made of glass or plastic, is secured to the plaque with fasteners, such as screws 156.

Thus, new, useful and desirable display devices for displaying sports memorabilia have been disclosed. In summary, a display device for displaying sports memorabilia as disclosed herein generally includes a plaque adapted to be hung on a wall and a support assembly secured to the plaque for supporting a piece of memorabilia in an upright position with respect to the wall.

The principles, preferred embodiments and modes of operation of the presently disclosed hanging display devices have been described in the foregoing specification. The presently disclosed display devices, however, are not to be construed as limited to the particular embodiments shown as these embodiments are regarded as illustrious rather than restrictive. Moreover, variations and changes may be made by those skilled in the art without departing from the spirit of the presently disclosed display devices as set forth by the following claims.

What is claimed is:

1. A display device for supporting a helmet, comprising:

a helmet;

a plaque;

a hanger secured to a rear face of the plaque for hanging the plaque on a vertical surface such that the rear face of the plaque is substantially parallel with the vertical surface;

a support assembly secured to a front face of the plaque for supporting the helmet, the support assembly including:

a spacer positioned between the helmet and the plaque, the spacer having a flat surface abutting the front face of the plaque and an opposing contoured surface abutting the helmet, the contoured surface of the spacer being contoured to match an outer contour of the helmet such that a centrally located vertical plane of the helmet is substantially parallel with the vertical surface; and a fastener passing through a hole in the helmet, through the spacer and secured to the plaque.

2. The display device of claim 1, wherein the front and the rear faces of the plaque are parallel.

3. The display device of claim 1 wherein the fastener comprises a screw and the support assembly also includes a washer positioned between a head of the screw and the helmet.

4. The display device of claim 1 wherein the hole in the helmet that the fastener passes through comprises an ear hole.

5. A display device for hanging on a vertical surface and holding a helmet, the device comprising:

a plaque;

a hanger secured to a rear face of the plaque for hanging the plaque on a vertical surface such that the rear face of the plaque is substantially parallel with the vertical surface; and a support assembly secured to a front face of the plaque and including, a spacer for positioning between the helmet and the plaque, the spacer having a flat surface for abutting the front face of the plaque and an opposing, malleable surface for abutting the helmet, wherein the malleable surface is for contouring to match an outer contour of the helmet such that a centrally located vertical plane of the helmet is substantially parallel with the vertical surface when the helmet abuts the spacer, and a fastener for passing through a hole in the helmet, through the spacer and secureable to the plaque.

6. The display device of claim 5, wherein the front and the rear faces of the plaque are parallel.

* * * * *